US005253750A

United States Patent [19]

Keffer

[11] Patent Number: 5,253,750

[45] Date of Patent: Oct. 19, 1993

[54] JEWELRY FRAME

[76] Inventor: Michael E. Keffer, 6536 W. Hefner, Oklahoma City, Okla. 73162

[21] Appl. No.: 8,445

[22] Filed: Jan. 22, 1993

Related U.S. Application Data

[63] Continuation-in-part of Ser. No. 877,289, May 1, 1992, abandoned.

[51] Int. Cl.[5] ..... B65D 73/00

[52] U.S. Cl. ..... 206/6.1; 206/566; 211/13

[58] Field of Search ..... 206/566, 493, 495, 806, 206/6.1; 211/13

[56] References Cited

U.S. PATENT DOCUMENTS

| | | | |
|---|---|---|---|
| 1,506,010 | 8/1924 | Lapin | 206/495 |
| 2,984,347 | 5/1961 | Kalinchuk | 206/419 |
| 3,339,745 | 9/1967 | Sugerman | 211/13 |
| 3,782,558 | 1/1974 | Schael, Jr. | 211/13 |
| 4,420,084 | 12/1983 | Whelan | 211/13 X |
| 4,664,264 | 5/1987 | Kirk | 211/13 |
| 4,767,011 | 8/1988 | Butler | 206/566 X |
| 4,905,821 | 3/1990 | Corbett | 206/566 X |
| 4,923,069 | 5/1990 | Germain et al. | 211/13 |
| 4,958,727 | 9/1990 | Bergeron | 206/6.1 |
| 5,050,745 | 9/1991 | Sanders | 206/495 X |
| 5,064,067 | 11/1991 | McAllister et al. | 206/420 |
| 5,121,833 | 6/1992 | Lindsay et al. | 206/6.1 |
| 5,141,300 | 8/1992 | Clesla | 206/566 X |
| 5,209,344 | 5/1993 | Smith | 206/495 X |

*Primary Examiner*—Steven N. Meyers
*Assistant Examiner*—Ted Kavanaugh
*Attorney, Agent, or Firm*—Robert K. Rhea

[57] ABSTRACT

A normally upright generally rectangular frame surrounded backboard having a front surface overlaid by a coextensive section of fabric is provided with a monofilament line tautly stretched across the fabric and backboard front surface within the frame from opposing sides thereof and defining a series of back-board longitudinally spaced parallel sections of the line which support a plurality of jewelry pricks when placed thereon and prevents sagging of the fabric relative to the backboard when supporting relatively heavy items of jewelry.

2 Claims, 1 Drawing Sheet

JEWELRY FRAME

This application is a continuation-in-part of an application filed by me in the U.S. Patent and Trademark Office on May 1, 1992 under Ser. No. 07/877,289 for Jewelry Frame Cabinet, now abandoned.

BACKGROUND OF THE INVENTION

1. Field of the Invention

This invention relates to a support for storing and displaying various types of jewelry and other small wearable items.

Jewelry is commonly stored in jewelry cabinets, jewelry boxes, or other containers for storing and displaying different types of jewelry such as earring stands, earring pouches or ring stands; however, the above are often expensive and will not satisfactorily store or display all the different types of jewelry and other small wearable items such as hairclips, watches, headbands, etc.

This invention provides a framed backboard for hanging all types of earrings and hairclips thereon and which enables pendants and brooches to be pinned to the backboard with other types of jewelry such as rings, necklaces, bracelets and other small wearable items such as watches and headbands.

2. Description of the Prior Art

U.S. Pat. No. 5,121,833, issued Jun. 16, 1992, to Lindsay for Jewelry Display and Travel Device, discloses a jewelry supporting roll-up section of fabric normally supported in its unrolled fashion by a string having its end portions attached to respective ends of a rod extending through an end loop of the fabric.

A plurality of bands extends transversely of the jewelry holding fabric, in spaced relation, longitudinally of its length. Each of the transverse bands are tacked in spaced-apart relation to the fabric longitudinally of the respective band for supporting jewelry items hung thereon.

U.S. Pat. No. 4,664,264, issued May 12, 1987, to Kirk for Card for Holding and Displaying Jewelry, discloses a rigid card provided with a transverse band gripping opposing side edges of the card and sufficiently flexible, relative to the card, to receive the clip portion of an earring when inserted between the band and the card for displaying jewelry.

U.S. Pat. No. 4,923,069, issued May 8, 1990, to Germain for Apparatus for Storing and Displaying Jewelry and U.S. Pat. No. 4,958,727 issued Sep. 25, 1990 to Bergeron for Showcase for Storing and Displaying Post-Type Earrings, are examples of the further state-of-the-art.

The Germain patent disclosing a frame supported backboard formed from jewelry post penetrateable material for supporting jewelry articles thereon and the Bergeron patent disclosing a plurality of hingedly connected box-like compartments for storing jewelry items and the like.

This invention is distinctive over the above and other patents by providing a frame supported rectangular backboard which features a layer of fabric on its front surface to which various articles of jewelry may be attached. An elongated monofilament line is transversely strung tautly across the front surface and angularly across its back surface, to form a series of vertically spaced parallel lengths of the line between the top end portion and bottom end portion of the backboard when disposed longitudinally upright. Various articles of jewelry may be hung or suspended from each parallel length of the line without any material sagging of the line, relative to its fixed positions, at opposing sides of the backboard.

SUMMARY OF THE INVENTION

An open frame surrounds the perimeter of a backboard having a front surface and a back surface and is provided with a support rack for hanging the frame from a nail, or the like, protruding from a vertical wall.

The front surface of the backboard is covered with a layer of fabric material capable of receiving pins, or the like, for attaching jewelry thereto.

A continuous length of elongated monofilament line is attached at one end portion to the back surface of the backboard adjacent one end and side edge thereof and extends tautly across the fabric overlying the front surface of the backboard in horizontal transverse relation from V-shaped grooves at respective opposing side edge surfaces of the backboard to form a series of vertically spaced parallel intermediate portions or lengths of the line extending in spaced-apart relation, longitudinally of the backboard. The line is connected at its other end portion to the back surface of the backboard adjacent the depending end and the side portion, opposite the first named side portion, for supporting jewelry items attached thereto with negligible sagging of the line between side edges of the backboard. The tautness of the line also acts to prevent sagging of the fabric, as a result of heavy items attached thereto, such as necklaces.

The principal object of this invention is to provide a device for the storage and display of a relatively large quantity of jewelry and small wearable items and form an attractive and artistic display in which features ease of locating and accessing each and every selected individual item.

DESCRIPTION OF THE PREFERRED EMBODIMENTS

Figure 1:
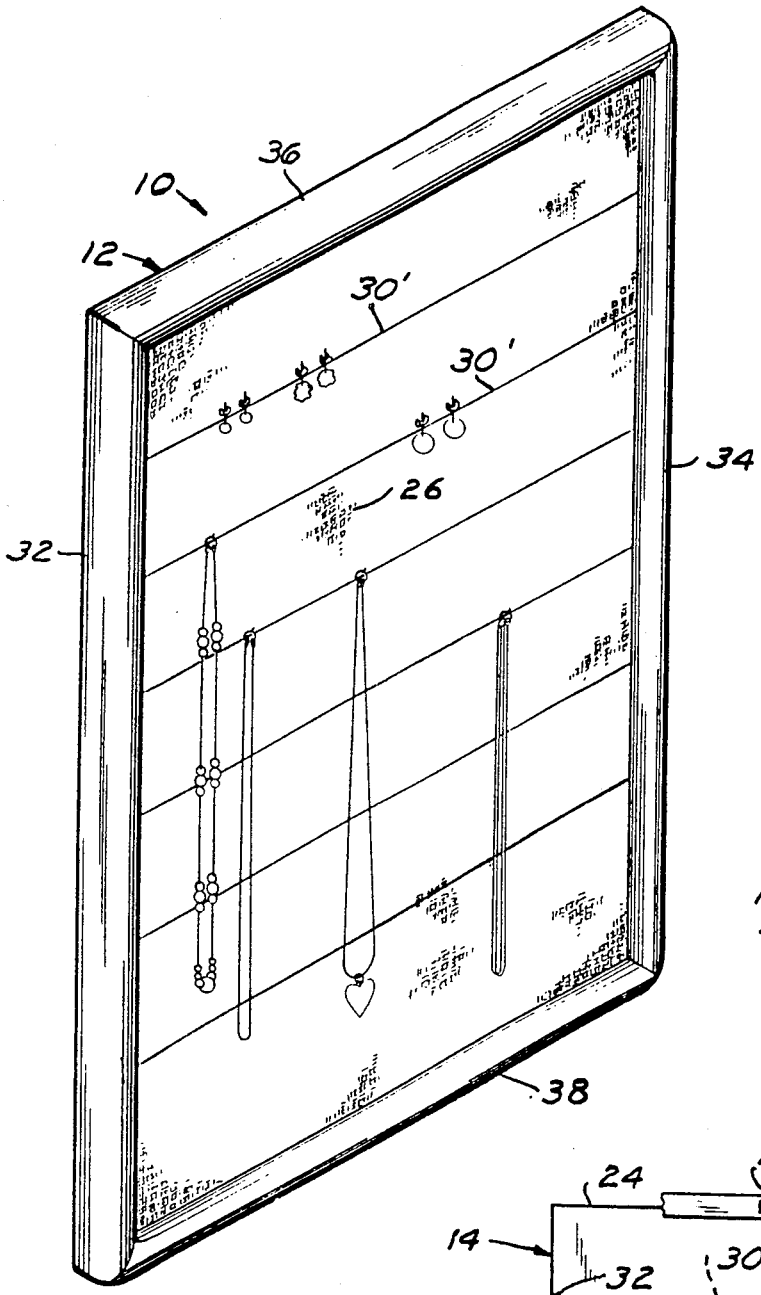
FIG. 1 is a perspective view of the jewelry frame having a number of jewelry items supported thereby.

Like characters of reference designate like parts in those FIGURES of the drawings in which they occur.

In the drawings:

The reference numeral 10 indicates the jewelry frame comprising a frame 12 surrounding a backboard 14 and is generally rectangular planar in overall configuration.

The backboard 14 may be of any desired thickness and defines a front surface 16 parallel with an opposite or back surface 18 and having opposing parallel side edge surfaces 20 and 22 and a top edge surface 24 parallel with a bottom edge surface, not shown.

A rectangular section of fabric material 26 is secured by its marginal edge portions to the marginal edge portions of the backboard in overlying relation on its front surface 16.

Figure 4:
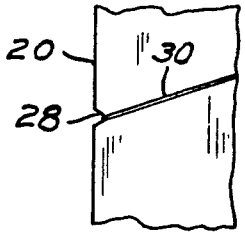
Figure 3:
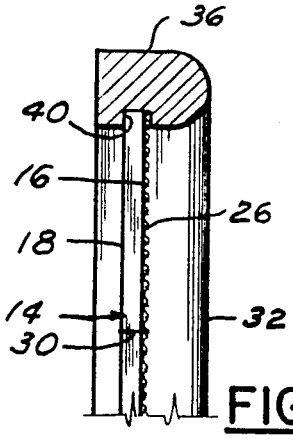
FIG. 3 is a fragmentary vertical cross sectional view taken substantially along the line 3—3 of FIG. 2; and, FIG. 4 is a fragmentary view, to an enlarged scale, of the area encompassed by the circular arrow 4.

The respective side edge surfaces 20 and 22 of the backboard are provided with a series of pairs of V-shaped grooves 28 (FIG. 4) extending transversely of the respective side edge surface, in equally spaced-apart relation, longitudinally of the backboard.

The depth of the V-shaped groove 28 is relatively shallow when compared with the thickness of the backboard.

Figure 2:
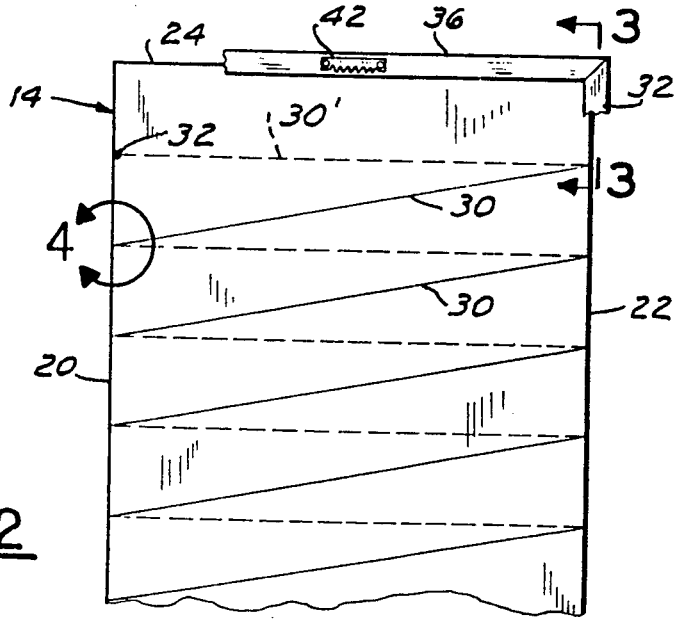
FIG. 2 is fragmentary elevational back view of the jewelry frame with a major portion of the surrounding frame removed for clarity.

An elongated length of uniform diameter elastomeric monofilament fishing line 30 is secured at one end portion, as by a nail 32, to the back surface 18 of the side edge portion 20 of the backboard adjacent its uppermost V-shaped slot 28, as viewed in FIG. 2. The line 30 is then tautly extended through the adjacent V-shaped slot 28 and horizontally across the backboard front surface 16, in overlying relation with respect to the fabric 26 and extended through the companion transversely aligned V-shaped slot 28 at the backboard right side surface 22, as viewed in FIG. 2. The monofilament line 30 is similarly extended angularly downward, to the left as viewed in FIG. 2, and through the next adjacent V-shape slot 28 and similarly strung horizontally across the forward surface 16 of the backboard and through the next V-shape slot 28, at the right side edge surface 22 of the backboard.

This line stringing action is continued with the monofilament line 30 forming a series of horizontal parallel line lengths 30' extending transversely of the backboard between its respective ends on its front or forward surface 16 with the other end of the monofilament line being similarly attached to the backboard rearward surface 18 by a nail, not shown, adjacent the depending end portion of the backboard.

The taut condition of the monofilament line, stretched to near its elastic limit, minimizes sagging of the fabric 26 when some relatively heavy jewelry items, such as necklaces, are attached thereto. The continuous length of line, extending in a wrap-around fashion between the respective end portions of the backboard, permits some flexing of the line forwardly of the front surface 16 and inserting a clip or hook between the line 30 and the fabric 26 when hanging jewelry items thereon.

The frame 12 comprises opposing side members 32 and 34 coextensive with the length of the backboard 14 and top and bottom cross members 36 and 38 respectively joining the side members at the top and bottom end surfaces of the backboard.

The respective inner confronting surfaces of the frame members 32, 34, 36, and 38 are coextensively provided with a cooperating groove 40 which nests a peripheral edge portion of the respective side edge surface 20, 22, 24 and bottom end surface of the backboard.

Centrally of its length, the rearward surface of the top frame transverse member 36 is provided with a conventional picture frame hanger 42 for cooperatively supporting the jewelry frame 10 on a vertical wall surface provided with a support such as a nail, neither being shown.

Obviously, similar frames attend may be constructed and hingedly connected with respective opposing side members 32 and 34 of the frame and respectively angularly disposed relative to the jewelry frame 10 to form a self-supporting upright three-section jewelry frame holder, if desired.

Obviously the invention is susceptible to changes or alterations without defeating its practicability. Therefore, I do not wish to be confined to the preferred embodiment shown in the drawings and described herein.

I claim:

1. A frame for holding and displaying items of jewelry, comprising:

a backboard formed from rigid planar material having opposing end edge surfaces, a front surface, a back surface and having opposing side edge surfaces;

a plurality of pairs of V-shaped grooves transversely formed in said side surfaces in equally spaced-apart relation from one said end surface; and, a length of elongated monofilament elastomeric line of uniform diameter secured by one end portion said backboard back surface adjacent one said end edge surface and adjacent one said side edge surface and adjacent one groove of the adjacent pair of said pairs of grooves and tautly extended through said adjacent groove and transversely across said backboard front surface and through the other groove of said adjacent pair of grooves in the other said side edge surface and angularly across said back surface to one groove of the next adjacent pair of grooves of said pairs of grooves and through said one groove of the next adjacent pair of grooves and transversely across said backboard front surface and through the other groove of said next adjacent pair of grooves and secured to said back surface adjacent the last named groove of said next adjacent pair of grooves, a rectangular frame means including a top member, a bottom member and opposing side members contiguously surrounding said backboard, said top, bottom and side members each having a coextensive groove in its surfaces for cooperatively nesting a peripheral edge portion of said backboard.

2. A frame for holding and displaying items of jewelry, comprising:

a backboard formed from rigid planar material having opposing end edge surfaces, a front surface, a back surface and having opposing side edge surfaces;

a plurality of pairs of V-shaped grooves transversely formed in said side surfaces in equally spaced-apart relation from one said end surface; and, a length of elongated monofilament line of uniform diameter secured by one end portion to said backboard back surface adjacent one said end edge surface and adjacent one said side edge surface and one groove of the adjacent pair of said pairs of grooves and tautly extended toward the other end edge surface of said backboard in a wrap-around action on the backboard while successively passing through the respective groove of each pair of grooves of said plurality of pairs of grooves, said line secured by its other end portion to the back surface of said backboard adjacent said other end edge surface of its opposing end edge surfaces, a rectangular frame means including a top member, a bottom member and opposing side members contiguously surrounding said backboard, said top, bottom and side members each having a coextensive groove in its surfaces for cooperatively nesting a peripheral edge portion of said backboard.

* * * * *